United States Patent [19]

Coates

[11] 4,169,582

[45] Oct. 2, 1979

[54] MESSAGE DELIVERY DEVICE

[76] Inventor: William J. Coates, 12004 78th Ave. S., Seattle, Wash. 98174

[21] Appl. No.: 829,934

[22] Filed: Sep. 1, 1977

[51] Int. Cl.[2] ..... B61K 1/00

[52] U.S. Cl. ..... 258/9

[58] Field of Search ..... 258/9, 11, 26, 23

[56] References Cited

U.S. PATENT DOCUMENTS

| | | | |
|---|---|---|---|
| 619,778 | 2/1899 | McKanna | 258/2 UX |
| 818,470 | 4/1906 | Rook | 258/9 |
| 895,307 | 8/1908 | Sappenfield | 258/26 X |
| 896,024 | 8/1908 | Keefe | 258/17 X |
| 1,086,283 | 2/1914 | Dutcher | 258/2 X |
| 1,398,137 | 11/1921 | Lumbard | 258/2 |
| 1,488,318 | 3/1924 | Cottingham | 258/26 |
| 1,907,222 | 5/1933 | Stewart | 258/2 UX |
| 1,978,322 | 10/1934 | Parks | 258/2 UX |
| 2,011,939 | 8/1935 | Mulcahy et al. | 258/2 |
| 2,289,213 | 7/1942 | Robertson | 258/2 UX |
| 2,492,854 | 12/1949 | Fowler | 48/188.7 X |
| 2,539,071 | 1/1951 | Glenn | 258/2 UX |

*Primary Examiner*—Stanley H. Tollberg
*Attorney, Agent, or Firm*—Graybeal & Uhlir

[57] ABSTRACT

The base section of an upstanding, telescoping mast is fixedly anchored in respect to the ground and the top section is vertically adjustable in respect to the base section. A plurality of horizontally disposed swing arms are pivotally supported in spaced vertical alignment along the height of the top section. The radially extending free end of each swing arm is slidably engageable into one end of the message tube of a message holder, in which tube is received a piece of paper on which a message is written. The ends of an arcuate tube are fixedly attached to the opposite end of the message tube to form a closed ring of sufficient diameter to enable an operator, who is passing by on a traveling vehicle, to extend his arm to the ring and pull the message holder free from the swing arm. Spring clips are attached to the free end of a swing arm for both limiting the endwise engagement between the swing arm and the message tube and for resisting rotational movement of the message tube in respect to the swing arm.

4 Claims, 3 Drawing Figures

MESSAGE DELIVERY DEVICE

BACKGROUND OF THE INVENTION

1. Field of the Invention

This invention relates to message delivery devices, and more particularly to devices for delivering messages to persons on a moving vehicle such as a railroad train.

2. Description of the Prior Art

During the normal operation of a railroad system, instructions or orders from dispatchers located at a station or the like must be transmitted to various crew members of a train as it passes by the station. Although the control of trains is becoming more automated and communication systems between the station and the moving train are becoming more sophisticated, a need still exists for expeditiously and economically passing written orders to the train crew, especially at more remotely located stations. Crew members in turn often must transmit information to dispatchers, clerks, or yard attendants.

Various devices have been used for passing up messages to train crew members. One such commonly used device is a fork type holder with the two tines of the fork outwardly diverging to form a "V" shape. A "loop", usually of string or twine, is clipped to the fork to lay along the length of the tines and to extend straight across the free ends of the tines to form a closed triangular shape. Generally, a message is tied to the portion of the string loop extending across the ends of the fork tines. The handle of the fork can be provided with sufficient length to enable a yard attendant standing alongside the train track to hold this fork type device upward so that the loop is close enough to the moving train to enable a crew member to extend his arm through the loop to pull it free of the fork. Alternatively, the fork tines can be attached to a shorter handle or arm, which arm extends horizontally from a vertical mast so that the message loop is supported adjacent to the traveling train and at an elevation for enabling said loop to be grabbed by a crew member.

A second type of known message delivery device is simply in the form of a ring having a clip attached thereto for holding a folded message. The ring is detachably connected to either a long handle which is held by a station attendant or to an arm which is supported horizontally by a vertical mast. Regardless of the method used to support the ring, it must be positioned close enough to the traveling train and at a proper elevation to enable a crew member to extend his hand and arm through the ring to pull the ring free from either the handle or the horizontal arm.

A disadvantage common to both the fork type and ring type message delivery devices is that because the paper on which the message is written is exposed, rather than placed inside a container, the paper must be wrapped to protect it from rain, snow and the like. A second disadvantage of these devices is that no provision is made for messages to be transmitted from the train crew members to the dispatcher or station attendant. A further disadvantage of the fork type delivery device is that for each message passed up to the train crew, a length of string must be cut from a ball, the string must be tied around the message bearing paper, and then finally the ends of the string must be tied together to form a continuous loop. This not only crumples the paper on which the message is written, but also requires a time consuming, expensive manual operation.

Summary of the Invention

The instant invention relates to a novel message delivery device for passing messages to an operator located on a moving vehicle, and in basic form comprises an upstanding two-piece telescoping mast, which mast has a base section fixedly anchored with respect to the ground and a top section positionable at a selected elevation in respect to the base section. A plurality of horizontally disposed swing arms are pivotally attached in vertically spaced alignment to the mast top section by mounting means. The free end of each swing arm, which extends radially of the mast, is slidably engageable into one end of a message tube. The message tube has a sufficiently long length and an adequate inside diameter to receive therein a rolled up piece of paper on which a message is written. The ends of a circular hoop are fixedly attached to the end portion of the message tube opposite the swing arm such that the plane defined by the hoop is parallel to the length of the message tube. Furthermore, the free end of the swing arm is provided with retaining means for both limiting the endwise engagement between the swing arm and the message tube and for resisting rotational movement of the message tube in respect to the swing arm. Thus, after a message is placed inside the message tube and after the message tube is engaged with the free end of the swing arm, the message holder can be slidably disengaged from the swing arm by an operator who is located on a traveling vehicle, extending his arm through the ring and pulling the ring from the swing arm.

It is an object of the invention to provide a message delivery device having a reusable message holder into which a message can be simply placed without having to be wrapped to protect the message from inclement weather.

Another object of the present invention is to provide a message delivery device constructed from a minimum of light-weight, inexpensive, readily available components to minimize the cost of the device, but without sacrificing the durability of the device.

A further object of the present invention is to provide a message delivery device which is inexpensive both to maintain and to operate.

Still another object of the present invention is to provide a message delivery device which can be used to transmit several messages to a moving vehicle simultaneously.

A further object of the present invention is to provide a message delivery device which is easily visible in the daylight or at night.

In addition, it is an object of the present invention to provide a message delivery device which can be used to pass messages from a stationary person to an operator in a moving vehicle, and from the operator in the moving vehicle to the stationary person.

One more object is to provide a message delivery device which does not require any structural modifications of the moving vehicle.

DESCRIPTION OF THE PREFERRED EMBODIMENT

Figure 1:
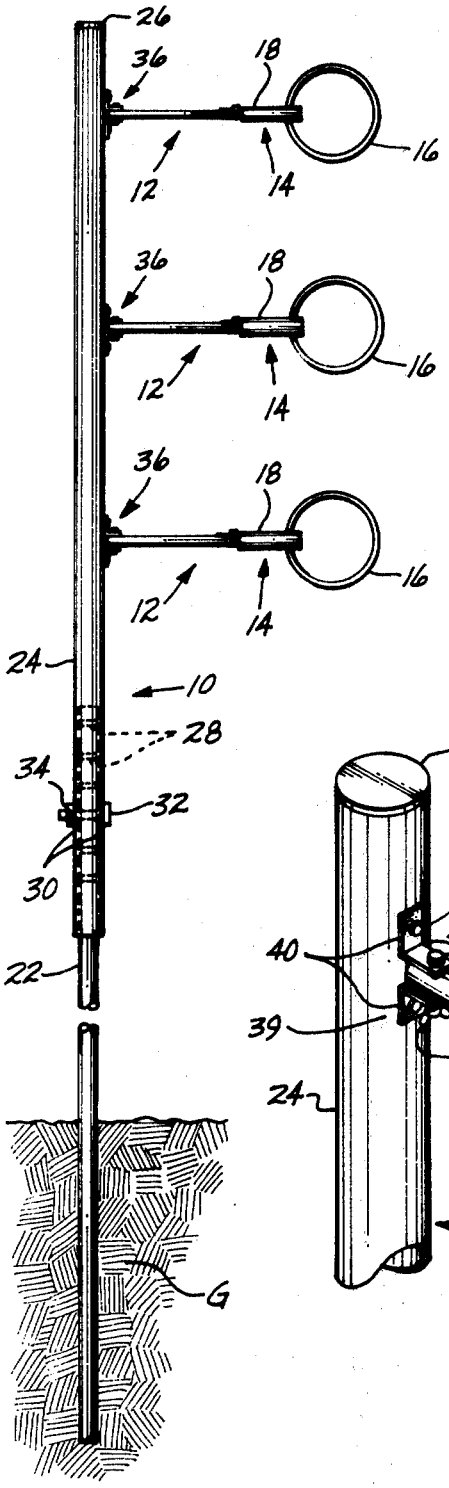
FIG. 1 is an elevational view of an embodiment of the present invention shown installed in the ground.

Referring initially to FIG. 1, shown installed in the ground G adjacent a railroad track or the like (not shown), is a typical message delivery device constructed according to the present invention. In preferred form, it comprises an upstanding telescoping mast 10 fixedly anchored with respect to the ground G. In the embodiment shown, three horizontally disposed swing arms 12 are each pivotally supported at one end by mast 10, each said swing arm pivoting about an axis parallel to said mast length. In each instance a message holder 14 is detachably supported by swing arm 12 and comprises an arcuate hoop 16 fixedly attached to one end of a message tube 18. The opposite end of each message tube 18 is slidably engageable over free end 20 of each swing arm 12.

Again, referring to FIG. 1, mast 10 includes upstanding base section 22, which base section has a lower end anchored into the ground G, and tubular top section 24, which top section has an inside diameter slightly larger than the outside diameter of said base section for enabling said top section to telescope snugly over the upper end of said base section. The upper end of mast top section 24 is provided with a cap 26 to prevent rain, snow and the like from entering mast 10. A series of spaced, vertically aligned, diametrically opposed pairs of holes 28 are located in the upper portion of base section 22; a corresponding diametrically opposed pair of holes 30 are located in the lower end portion of mast top section 24. Fastener means in the form of cap screw 32 is engageable through holes 30 in mast top section 24 and through a selected pair of diametrically opposed holes 28 in mast base section 22 to position said mast top section at different elevations. Nut 34 retains cap screw 32 engaged with mast base section 22 and mast top section 24. It is to be appreciated that other well known fasteners, such as a pin combined with a cotter key, are usable to perform the same function as cap crew 32 and nut 34.

It is preferable that top section 24 and base section 22 of mast 10 be constructed of round plastic tubing, thus enabling said mast to be lightweight, durable, inexpensively made. Furthermore, by utilizing round plastic tubing, mast top section 24 can be easily rotated 180°, to use the present invention in conjunction with operators traveling along either side of mast 10. Moreover, the exterior surfaces of mast 10 are covered with a fluorescent coating of a color, such as orange, to permit said mast to be visible from a considerable distance during daylight hours. Also, such fluorescent coating allows said mast to be readily visible when a light is shined on it at night.

Figure 2:
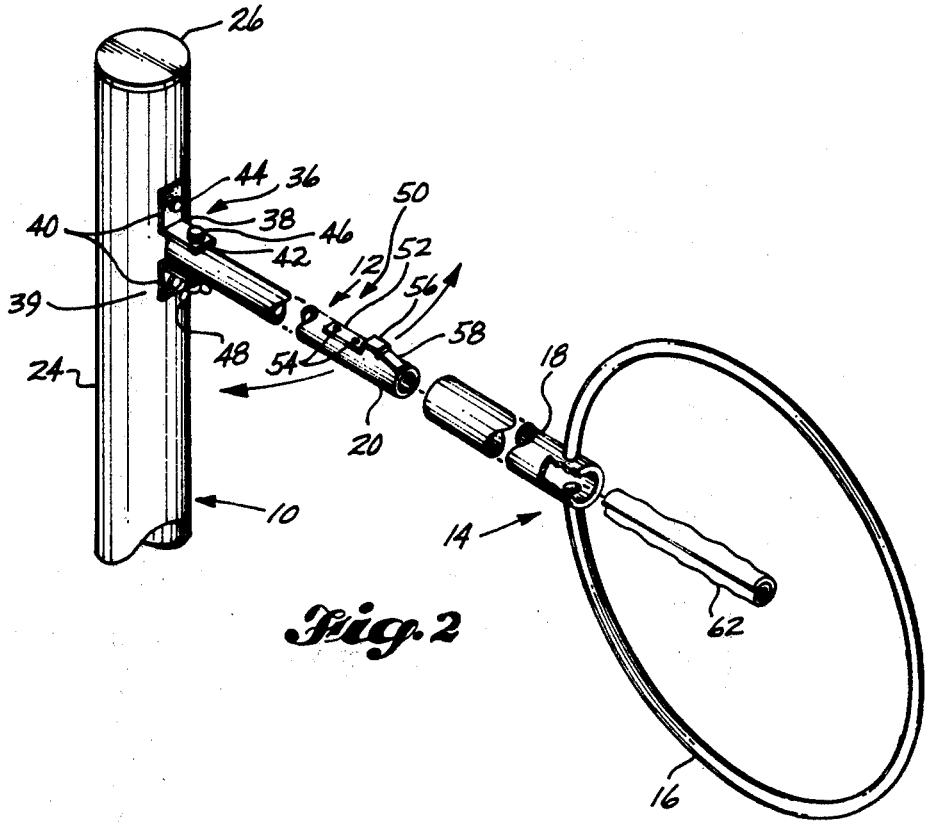
FIG. 2 is an enlarged fragmentary pictorial view of the mast illustrating the upper most swing arm with the corresponding message holder detached therefrom.
Figure 3:
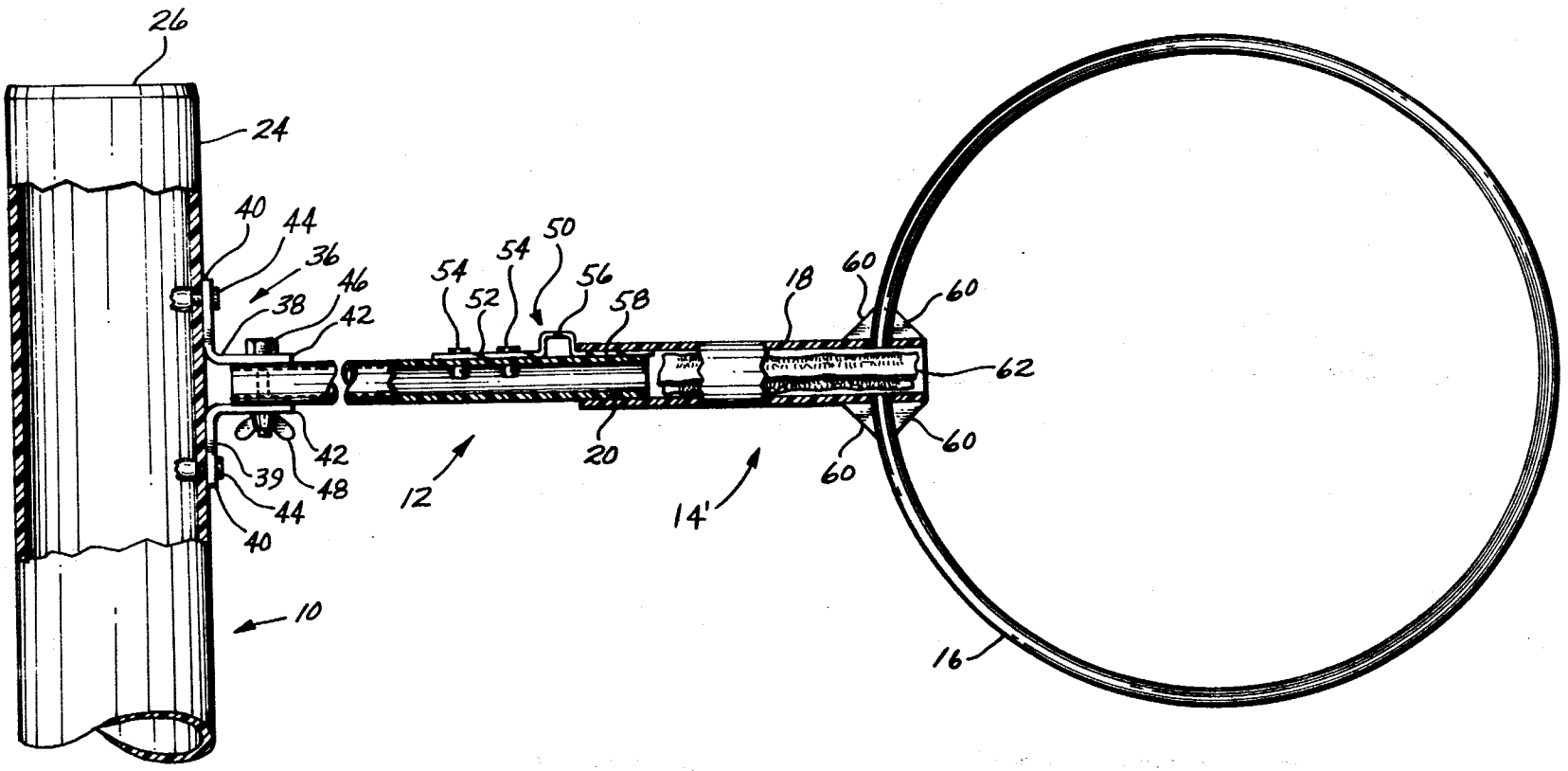
FIG. 3 is an enlarged partial cross section of the message delivery device shown in FIG. 2 taken substantially along line 3—3 thereof.

Each elongate, horizontally disposed swing arm 12, as best shown in FIGS. 2 and 3, is pivotally mounted to mast top section 24 by mounting means 36. Said mounting means includes vertically spaced upper angle bracket 38, and lower angle bracket 39, which brackets have oppositely extending, vertically aligned, legs 40 and have horizontal legs 42 extending radially from mast top section 24 in spaced parallel relationships. Said brackets are fixedly attached to mast top section 24 by fastener means, such as rivets 44, extending through a hole provided in vertical leg 40 and through a corresponding hole provided in said mast top section. With each swing arm 12 positioned between angle bracket horizontal legs 42, cap screw 46, extends downward sequentially through aligned holes provided in horizontal leg 42 in upper angle bracket 38, swing arm 12, and horizontal leg 42 of lower angle bracket 39; wing nut 48 prevents endwise movement of capscrew 46. It is preferable that the components of mounting means 36 be of corrosion resistant, high strength material, such as stainless steel.

The above structure enables every swing arm 12 to pivot a total of approximately 180°. By initially aligning swing arms 12 perpendicular to the direction of travel of a moving operator, such swing arms can pivot 90°in either direction in response to the movement of the corresponding hoop 16 when said hoop is pulled by the traveling operator. Thus, the present invention can accommodate operators traveling in either direction in respect to mast 10.

Furthermore, the frictional force between each swing arm 12 and angle brackets 38 and 39 can be modulated by altering the engagement between wing nut 48 and cap screw 46. Enough frictional force can be created to prevent movement of swing arms 12 due to blowing winds, but still permit rotational movement of said swing arms when hoop 16 is grabbed by a moving operator.

Each swing arm 12, as shown in FIGS. 2 and 3, is constructed of round tubular material. Preferentially, the tubular material is of plastic, such as ABS; this would minimize its cost while still ensuring that its strength is adequate to support message holder 14. It is also preferable that each swing arm be covered with a fluorescent coating, of for instance, orange color, to enable it to be seen from a considerable distance.

Message tube 18 of each message holder 14, as shown in FIG. 3, is sized to snugly slide over free end 20 of swing arm 12. The maximum depth of engagement and the angular orientation of each swing arm 12 in respect to its corresponding message tube 18 is controlled by retaining means in the form of spring clip 50, which clip is fixedly attached to free end 20 of said swing arm. Said spring clip is formed a first leg section 52, extending parallel to swing arm 12 and fixedly attached to said swing arm by a pair of rivets 54. Said rivets extend through holes spaced along the length of first leg section 52 and through corresponding holes provided in free end 20 of swing arm 12. Rising outwardly from the end of first leg section 52 nearest message tube 18 is U-shaped central section 56 of spring clip 50. U-shaped section 50 abuts against the end of message tube 18 opposite hoop 16 to limit the engagement of said message tube with swing arm 12. Extending from clip central portion 56 in a direction opposite first leg section 52 is second leg section 58 of spring clip 50, which second leg deflects to frictionally engage against the inside surface of message tube 18 when message holder 14 is engaged with swing arm 12. Thus, second leg section 58 prevents message holder 14 from rotating in respect to swing arm 12.

Each arcuate hoop 16 is formed substantially in the shape of a circle, which circle has a diameter substantially larger than that of a normal arm to permit a traveling operator to extend his arm through said hoop when grabbing message holder 14. Each hoop 16 is closed by fixedly attaching its ends perpendicularly to the end portion of message tube 18 opposite swing arm 12, said hoop ends are shown in FIG. 3 as being received through diametrically opposed holes provided in said message tube. With each hoop 16 thus attached to message holder 14, the plane defined by said hoop is located parallel to the length of said message tube.

To minimize the weight and therefore the resisting inertia of each message holder 14, hoop 16 and message tube 18 are both constructed of plastic tubing, of for example, ABS plastic. The diameter of the hoop material is substantially smaller than the diameter of message tube 18, to further reduce this resisting inertia. Furthermore, the possibility that an operator's hand or arm will be injured when removing message holder 14 from a swing arm 12 is minimized by forming each hoop 16 from material having a generally circular cross section. Moreover, to insure that message holders 14 will be visible to the approaching operator, each hoop 16 and each message tube 18 are covered with a fluorescent coating of, for instance, orange color.

The structure of the present invention enables a plurality of swing arms 12 and message holders 14 to be mounted on mast top section 24. FIG. 1 shows three such swing arms and corresponding message tubes supported in spaced vertical alignment by mast top section 24 to enable, for example, different messages to be passed to various memebers of a train crew. The top message holder can be reserved for the head engineer, the middle message holder for the helper engine engineer, and the bottom message holder can be for the conductor. Thus, by simply looking down the track to see if his particular message holder is attached to the corresponding swing arm, it is possible for a particular crew member to determine if a message is awaiting him. Alternatively, the message holders can be color coded, enabling a particular crew member to ascertain if a message is being passed up to him by looking to see if a message holder of his particular color is attached to the corresponding swing arm.

The structure of the instant message delivery device also allows swing arm 12 and message holder 14 to pivot with the movement of the traveling operator's arm so that the direction of the force applied to message holder 14, when hoop 16 is grabbed by an operator, is aligned with the length of said swing arm and said message tube. Thus, message tube 18 will readily disengage from swing arm free end 20. If, instead, swing arm 12 were mounted stationary on mast top section 24, a bending force would be imparted on swing arm free end 20 by message tube 18. This bending force would cause message tube 18 to bind with respect to swing arm 12 and thereby would make removal of message holder 14 from said swing arm difficult. Moreover, if swing arm 12 were rigidly mounted to mast top section 24, the connection between said two members would have to be constructed to withstand this same bending force. A rigidly mounted swing arm 12, furthermore, would result in a torsional load being applied to the ends of hoop 16 when said hoop is pulled laterally by a traveling operator. Thus, the connection between hoop 16 and message tube 18 would have to be designed to withstand a larger combined loading than is required to be withstood if swing arm 12 were free to pivot as in the instant structure.

In typical use, with upstanding mast base section 22 fixed in respect to the ground, mast top section 24 is vertically adjusted to position message holders 14 at desired elevations. A message 60 is placed within message tube 18, and then said message tube is slidably engaged over free end 20 of swing arm 12. To permit a traveling operator to more easily grab hoop 16, said hoop is oriented in a vertical plane and swing arm 12 is aligned perpendicular to the direction of travel of such operator. As the operator passes by, he simply extends his hand through hoop 16 to hook said loop and thus pulls message holder 14 free from swing arm 12. After removing message 60 from message tube 18, the traveling operator simply tosses message holder 14 to the ground so that it can then be retrieved by the station attendant. If the operator himself wishes to transmit a message, he can simply place his message in the tube after removing the existing message and then toss message holder 14 to the ground, either during the same pass by or during a subsequent pass by.

A slightly altered message holder 14' is shown in FIG. 3 as incorporating four triangular shaped braces 60 positioned at the junction of hoop 16 and message tube 18. Such braces serve to reinforce the connection formed between said hoop and said message tube.

What is claimed is:

1. A message delivery device for use with an upstanding mast having a base section fixedly anchorable with respect to the ground, a top section telescopable in respect to the base section, and connector means for maintaining said top section in a selected position in respect to the base section, said device comprising:

(a) a plurality of generally horizontal swing arms disposed in spaced vertical alignment with each other, each of said arms having an inboard end pivotally attached to the mast top section, and a free end extending radially outwardly of the mast;

(b) mounting means for mounting each of said swing arms to pivot at least 180°about an axis parallel to the mast, said mounting means being adjustable for applying a selective torque pre-load to each of said swing arms for resisting pivotal movement of each of said swing arms to thereby maintain each of said swing arms in nominally stationary angular orientation with respect to the mast; and, (c) a message holder for use with each of said swing arms, each message holder including an arcuate hoop and a message tube for receiving messages, each of said tubes including a first end slidably engageable and disengageable with a corresponding swing arm free end to form a telescoping joint therewith, and a second end fixedly attached to said hoop to form a closed ring therewith;

each of said message holders, with a message placed in its corresponding message tube and with the first end of said message tube engaged with a corresponding swing arm, being slidably disengageable from said corresponding swing arm by an operator, moving past the device on a traveling vehicle, extending his arm through said hoop and pulling said message holder from said corresponding swing arm.

2. A message delivery device according to claim 1, wherein each of said swing arms is constructed from a substantially straight, lightweight, corrosion resistant, tubular member; and each of said swing arms having spring clip means attached to its free end portion for limiting endwise engagement between each of said swing arms and its corresponding message tube and for resisting rotational movement of each of said message holders with respect to its corresponding swing arm.

3. A message delivery device according to claim 1, wherein said message tube is in the form of a substantially straight, elongate, lightweight tubular member; and said hoop is of lightweight material having a substantially circular cross section of a diameter substantially smaller than the width of said message tube to minimize the resisting inertia of said message holder when said hoop is pulled by a traveling operator.

4. A message delivery device according to claim 2, wherein said swing arm and said message holder are constructed from components having a fluorescent outer surface for enabling said swing arm and said message holder to be visible by an operator located at a considerable distance from said swing arm and said message holder.

* * * * *